US005589915A

United States Patent [19]

Hashimoto

[11] Patent Number: 5,589,915

[45] Date of Patent: Dec. 31, 1996

[54] ELECTROPHOTOGRAPHIC IMAGE FORMING APPARATUS WITH TONER BOX EXCHANGE ALARM FEATURE

[75] Inventor: Kouji Hashimoto, Matsudo, Japan

[73] Assignee: Canon Kabushiki Kaisha, Tokyo, Japan

[21] Appl. No.: 403,412

[22] Filed: Mar. 14, 1995

[30] Foreign Application Priority Data

Mar. 15, 1994 [JP] Japan ..... 6-044035
Mar. 7, 1995 [JP] Japan ..... 7-047241

[51] Int. Cl.[6] ..... G03G 21/10

[52] U.S. Cl. ..... 399/120; 399/13; 399/30

[58] Field of Search ..... 355/200, 210, 355/209, 245, 260, 327, 206, 298

[56] References Cited

U.S. PATENT DOCUMENTS 4,739,367 4/1988 Watanabe .
4,750,015 6/1988 Ogura et al. .
5,206,692 4/1993 Ishida et al. ..... 355/260

*Primary Examiner*—R. L. Moses
*Attorney, Agent, or Firm*—Fitzpatrick, Cella, Harper & Scinto

[57] ABSTRACT

An image forming apparatus for forming an image on a recording medium, includes a frame of the image forming apparatus, and a toner container mounting for removably mounting a toner container for containing toner removed from an image bearing member provided in the frame. The toner container mounting is removably mounted to the frame. An opening/closing member openable with respect to the frame is adapted to be opened and closed to dismount and mount the toner container with respect to the frame, and a regulating devise for regulating the closing of the opening/closing member when the toner container is not mounted to the frame.

38 Claims, 10 Drawing Sheets

ELECTROPHOTOGRAPHIC IMAGE FORMING APPARATUS WITH TONER BOX EXCHANGE ALARM FEATURE

BACKGROUND OF THE INVENTION

1. Field of the Invention

The present invention relates to an electrophotographic image forming apparatus for forming an image on a recording medium by using an electrophotographic process. The electrophotographic image forming apparatus may be an electrophotographic copying machine, an electrophotographic laser beam printer, or an electrophotographic facsimile machine, for example. Further, the electrophotographic image forming apparatus may be a full-color electrophotographic copying machine, a full-color electrophotographic laser beam printer, or a full-color electrophotographic facsimile machine.

2. Related Background Art

In conventional electrophotographic image forming apparatuses, toner removed from an electrophotographic photosensitive member is conveyed to a toner box by a screw. When the toner box is filled with the toner, the toner box is exchanged for a new toner box.

The present invention relates to improvement in the conventional techniques.

SUMMARY OF THE INVENTION

An object of the present invention is to provide an electrophotographic image forming apparatus which can improve operability.

Another object of the present invention is to provide an electrophotographic image forming apparatus which can prevent image formation if a toner container is not mounted to the image forming apparatus.

A further object of the present invention is to provide an electrophotographic image forming apparatus in which an opening/closing member cannot be closed if a toner container is not mounted to the image forming apparatus.

A still further object of the present invention is to provide an electrophotographic image forming apparatus wherein a condition that an amount of toner in a toner container reaches a predetermined amount can be detected by a detection means if a toner container is not mounted to the image forming apparatus.

The other object of the present invention is to provide an electrophotographic image forming apparatus which cannot be driven if a toner container is not mounted to the image forming apparatus.

DETAILED DESCRIPTION OF THE PREFERRED EMBODIMENTS

An embodiment of an electrophotographic image forming apparatus to which the present invention is applied will be explained with reference to the accompanying drawings. In the embodiment which will be described hereinbelow, the image forming apparatus is embodied as a full-color laser beam printer having a plurality of developing devices to permit formation of a full-color image. Further, as will be described later, a process cartridge B is removably mounted to the laser beam printer A.

Figure 1:
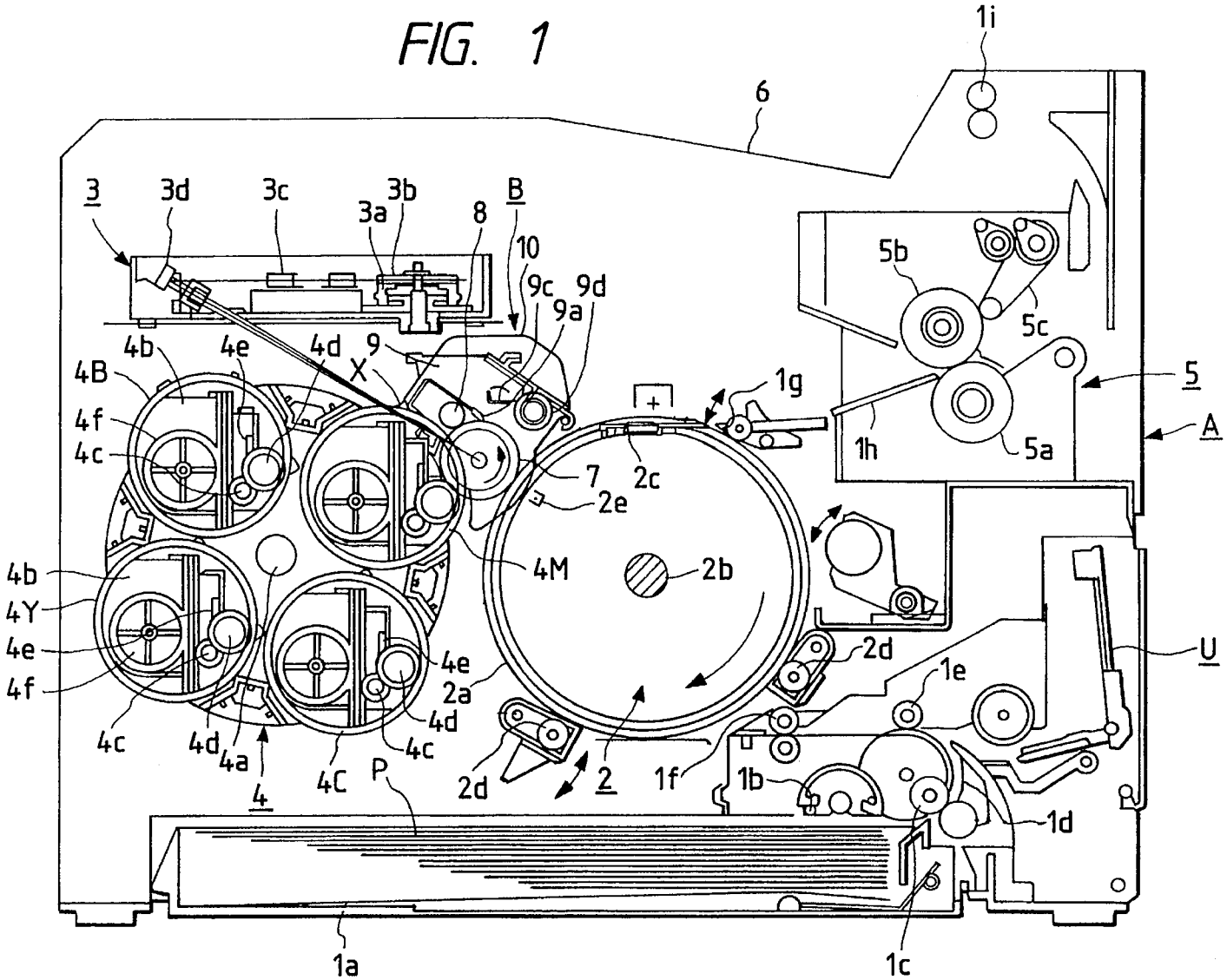
FIG. 1 is an elevational sectional view of an electrophotographic image forming apparatus (full-color laser beam printer) to which an embodiment of the present invention is applied.
Figure 2:
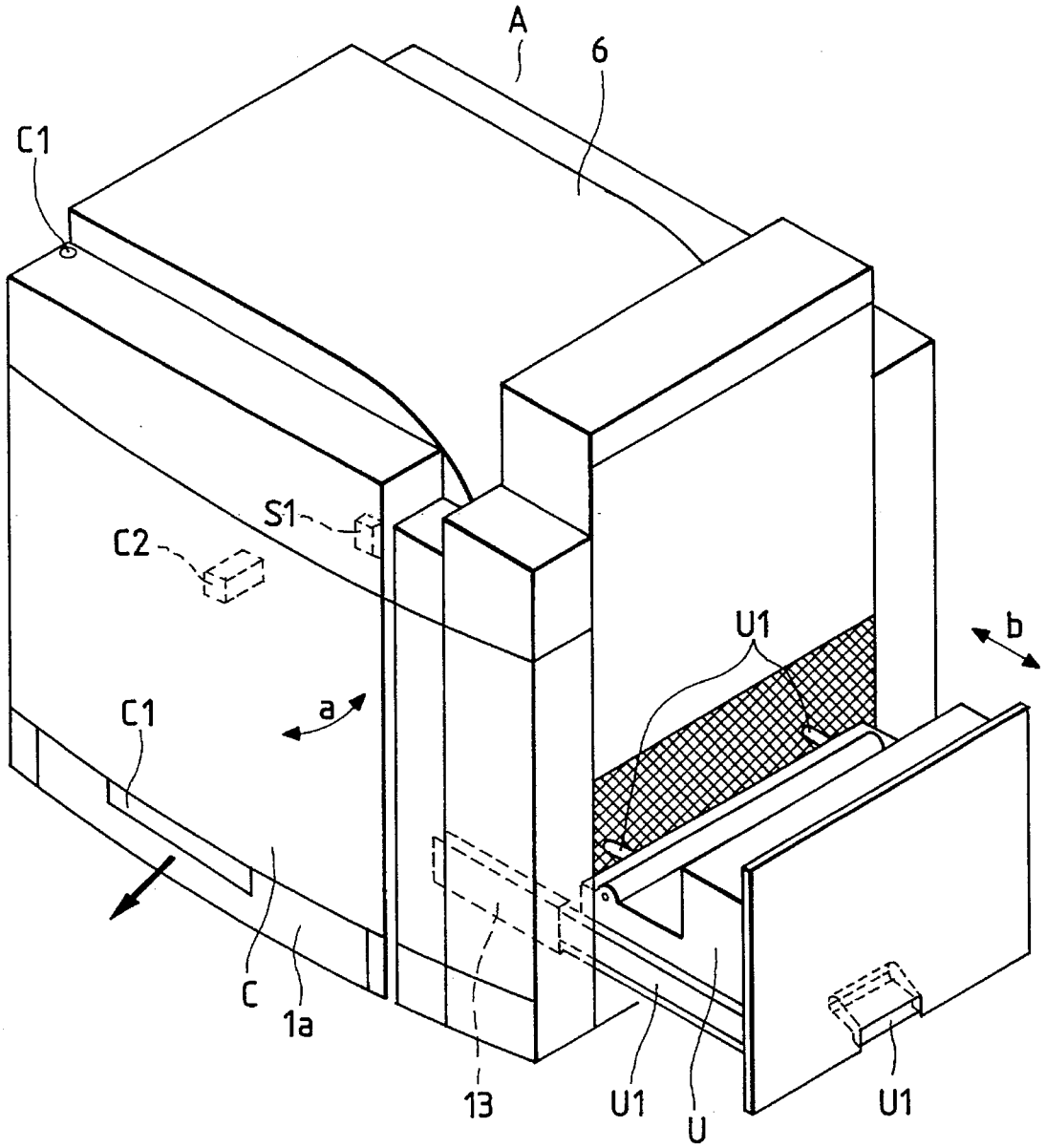
FIG. 2 is a perspective view of the electrphotographic image forming apparatus of FIG. 1.

FIG. 1 is a sectional view of the full-color laser beam printer, and FIG. 2 is a perspective view of the full-color laser beam printer. Firstly, the entire construction and various parts of the full-color laser beam printer will be explained, and then, the entire construction and various parts of the process cartridge will be explained.

Full-color Laser Beam Printer

First of all, the entire construction of the full-color laser beam printer will be explained. As shown in FIG. 1, in the printer, a recording sheet P is conveyed by a convey means 1 and is wound around a transfer drum 2*a* of a transfer means 2. In synchronous with this, a light image from a scanner portion 3 is illuminated onto a drum-shaped electrophotographic photosensitive member (photosensitive drum) 7 provided in the process cartridge B, thereby forming a latent image on the photosensitive drum. Then, latent images formed on the drum are developed by driving a developing unit 4 having four developing devices as developer (toner) images for various colors, which color toner images are successively transferred onto the recording sheet P in a superimposed fashion. The recording sheet P to which the toner images were transferred is sent to a fixing device 5, where the toner images are permanently fixed to the recording sheet as a full-color image. Thereafter, the recording sheet is discharged onto a discharge portion 6 formed on a frame of the printer.

In the full-color laser beam printer A, the process cartridge B, the developing devices (or toner cartridges) of the developing unit 4 and a sheet supply cassette (recording sheet supply cassette) 1*a* can be mounted to and dismounted from the frame of the printer along the same direction (i.e. from this side of the plane of FIG. 1). The dismounting and mounting of these elements are effected by opening and closing a opening/closing cover C with respect to the frame of the printer. The opening/closing cover C is pivotally mounted to the printer frame via a shaft CS for opening and closing movements in directions shown by the arrow a. The cover C is also opened to perform maintenance (including a sheet jam treatment). A gripper C1 is used to mount and dismount the cassette 1*a*.

Convey Means

The convey means 1 recording sheets P stacked in the sheet supply cassette 1*a* one by one. In this convey means 1, the recording sheets P are fed out one by one from the sheet supply cassette 1*a* by a pick-up roller 1*b* and a sheet supply roller 1*c*. The fed recording sheet P is sent, through a guide plate 1*d* and a relay roller 1*e*, to a pair of register rollers 1*f* which convey the recording sheet to the transfer drum 2*a* at a predetermined timing. On the other hand, a recording sheet P to which the toner images were transferred is separated from the transfer drum 2*a* by a separation member 1*g*, and the separated sheet is guided by a guide plate 1*h* to the fixing device 5. The recording sheet P discharged from the fixing device is discharged onto the discharged portion 6 formed on the printer frame through a pair of discharge roller 1*i*.

Further, as shown in FIG. 2, the rollers 1*b*, 1*c*, 1*e* and 1*f* and the guide plate 1*d* are assembled as a unit U which can be mounted to and dismounted from the printer frame along directions shown by the arrow b. Incidentally, the reference numeral U1 denotes a gripper and U2 denotes rails.

Transfer Means

The transfer means serves to transfer the toner image formed on the photosensitive drum 7 onto the recording sheet P, and, in the illustrated embodiment, the recording sheet P is wound around the transfer drum 2*a* rotated in a direction shown by the arrow in FIG. 1 and different color toner images are successively transferred onto the same recording sheet P in a superimposed fashion. The transfer drum 2*a* has an outermost dielectric layer and is rotated around a shaft 2*b* by a driving force from a drive motor (not shown). Grippers 2*c* provided on the peripheral surface of the drum at predetermined positions serve to grip or hold a tip end of the recording sheet P sent from the pair of register rollers 1*f*.

Further, in the proximity of the peripheral surface of the transfer drum 2*a*, there is provided an electrostatic absorb roller 2*d* which can be engaged by and disengaged from the transfer drum 2*a*. The recording sheet P is pinched between the electrostatic absorb roller 2*d* and the transfer drum 2*a* so that the recording sheet is urged against the peripheral surface of the transfer drum 2*a*. By applying a voltage between the electrostatic absorb roller 2*d* and the transfer drum 2*a*, charges are generated in the recording sheet P (dielectric body) and the dielectric layer of the transfer drum 2*a*, thereby electrostatically absorbing the recording sheet P to the peripheral surface of the transfer drum 2*a*. Further, a transfer charger 2*e* is disposed within the transfer drum 2*a* in a confronting relation to the photosensitive drum 7. When the recording sheet P held by the transfer drum 2*a* is contacted with the photosensitive drum 7, by applying to the transfer charger 2*e* a voltage having polarity opposite to that of the toner image formed on the photosensitive drum 7, the toner image is transferred onto the recording sheet P.

Incidentally, the method for absorbing the recording sheet P to the transfer drum 2*a* is not limited to the above-mentioned electrostatic method. For example, the recording sheet may be absorbed to the transfer drum by air suction.

Scanner Portion

The scanner portion 3 serves to illuminate laser light onto the photosensitive drum 7 in response to an image signal. In the scanner portion 3, light (for each color) emitted from a laser diode 3*a* in response to an image signal is scanned by a rotating polygon mirror 3*b*, and the light reflected by the polygon mirror is illuminated onto the photosensitive drum 7 through a focusing lens 3*c* and a reflection mirror 3*d*, thereby forming the latent image.

Developing Means

The developing unit 4 serves to develop the latent image formed on the photosensitive drum 7 with magenta color toner, cyan toner color, yellow color toner or black color toner to visualize the latent image as a color toner image. To this end, the developing unit 4 includes developing devices for developing the latent images with respective colors (magenta developing device 4M, cyan developing device 4C, yellow developing device 4Y, and black developing device 4B).

The above-mentioned four developing devices 4M, 4C, 4Y and 4B can be rotated by a rotation mechanism (not shown) so that the developing devices 4M, 4C, 4Y and 4B are successively brought to a position opposed to the photosensitive drum 7 in accordance with the image formation processes. That is to say, the developing devices 4M, 4C, 4Y and 4B are disposed around a rotary shaft 4*a* for rotational movement by 90 degrees each time. Further, centers of the developing devices 4M, 4C, 4Y and 4B are rotated in synchronous with rotation of rotation gears (not shown) disposed on a peripheral surface of a revolution gear (not shown) so that the postures of the developing devices are always maintained constant. The developing devices 4M, 4C, 4Y and 4B are identical in shape (but contain different color toners) and each has a toner container 4*b*, a coating roller 4*c*, a developing roller 4*d*, a developing blade 4*e*, and spacer members 4*g*.

During image formation, the developing devices 4M, 4C, 4Y and 4B are rotated around the shaft 4*a*, and the developing devices 4M, 4C, 4Y and 4B are stopped to be opposed to the photosensitive drum 7 in response to magenta, cyan, yellow and black developing operations, respectively. In this case, after the spacer members 4*g* provided on both end portions of the developing roller 4*d* abut against both end portions of the photosensitive drum 7 to create a small gap between the roller and the drum, a color toner image is formed on the photosensitive drum 7 with the corresponding color toner. That is to say, in each of the developing devices 4M, 4C, 4Y and 4B, toner in the toner container is sent to the coating roller 4*c* by a toner feed mechanism (not shown), and a toner layer is formed on a peripheral surface of the rotating developing roller 4*d* by the rotating coating roller 4*c* and the developing blade 4*e*, thereby charging the toner (friction charge). By applying development bias between the developing roller 4*d* and the photosensitive drum 7 on which the latent image is formed, a toner image corresponding to the latent image is formed on the photosensitive drum 7.

Regarding the replenishment of toner to the toner container 4*b*, the toner container 4*b* is provided with a mounting portion to which a cylindrical toner cartridge 4*f* can be removably mounted. In this case, the toner cartridge 4*f* can be inserted into the mounting portion from a longitudinal direction (from this side to that side of the printer shown in FIG. 1).

Incidentally, although not shown, when the developing devices 4M, 4C, 4Y and 4B are rotated by 90 degrees successively, the cartridge mounting portions are successively changed so that the toner cartridge 4*f* can be exchanged at a predetermined position.

Fixing Means

The fixing means 5 serves to fix the transferred toner to the recording sheet P. As shown in FIG. 1, the fixing means comprises a rotating drive roller 5*a*, and a fixing roller 5*b* urged against the drive roller and adapted to apply heat and pressure to the recording sheet P. That is to say, a recording sheet P separated from the transfer drum 2*a* is conveyed by the drive roller 5*a* and is subjected to heat and pressure from the fixing roller 5*b* so that the non-fixed toner images are fixed to the recording sheet P.

A cleaning member 5*c* is contacted with the fixing roller 5*b* so that residual toner remaining on the fixing roller 5*b* is removed by the cleaning member 5*c* and offset preventing agent is coated on the fixing roller.

Process Cartridge

As shown in FIG. 1, the process cartridge B incorporates therein the drum-shaped electrophotographic photosensitive member (photosensitive drum) 7, and at least one process means acting on the photosensitive drum 7. In the illustrated embodiment, as the process means, a first charge means 8 and a cleaning means 9 are incorporated into a cartridge frame 10 as a unit. Incidentally, the process cartridge B has a removable protection cover for protecting an exposed portion of the photosensitive drum 7 when the cartridge is not mounted to the printer.

Next, various parts of the process cartridge will be explained.

Electrophotographic Photosensitive Member

In the illustrated embodiment, the photosensitive drum 7 is constituted by coating an organic photo-conductive layer (electrophotographic photosensitive body) on a peripheral surface of an aluminum cylinder and is rotated in a direction shown by the arrow in FIG. 1 during image formation.

Incidentally, the electrophotographic photosensitive body is not limited to the photosensitive drum 7, but may be, for example, a photo-conductive body such as amorphous silicone, amorphous celenium, zinc oxide, titanium oxide or an above-mentioned organic photo-conductive body (OPC). Such photosensitive body may be supported on a rotating belt or sheet, as well as the drum. In general, a photosensitive drum or a photosensitive belt is used, and in the photosensitive drum, the photo-conductive layer is coated or deposited on the aluminium cylinder as mentioned above.

Charge Means

The first charge means 8 is a so-called contact charge type wherein a conductive charge roller 8 is contacted with the photosensitive drum 7 and the surface of the photosensitive drum 7 is uniformly charged by applying a voltage to the conductive roller. The conductive roller 8 is driven by rotation of the photosensitive drum 7.

Cleaning Means

The cleaning means 9 serves to remove and collect residual toner (referred to as "waste toner" hereinafter) remaining on the photosensitive drum 7 after the toner image formed on the photosensitive drum 7 by the developing device of the developing unit 4 has been transferred to the recording sheet P and to convey the waste toner to a waste toner containing box 11 mounted to the cartridge. The cleaning means 9 according to the illustrated embodiment comprises an elastic cleaning blade 9*a* for scraping the waste toner from the photosensitive drum 7, a dip sheet 9*b* for preventing the scraped waste toner from leaking toward the drum, an agitating member 9*c* for agitating the waste toner, and a toner convey screw 9*d* for conveying the waste toner collected by the agitating member 9*c* into the waste toner containing box 11. These elements 9*a*–9*d* are incorporated into the cartridge frame 10.

Now, the mounting and dismounting of the waste toner containing box 11 with respect to the printer will be explained with reference to FIGS. 3 to 8.

Figure 3:
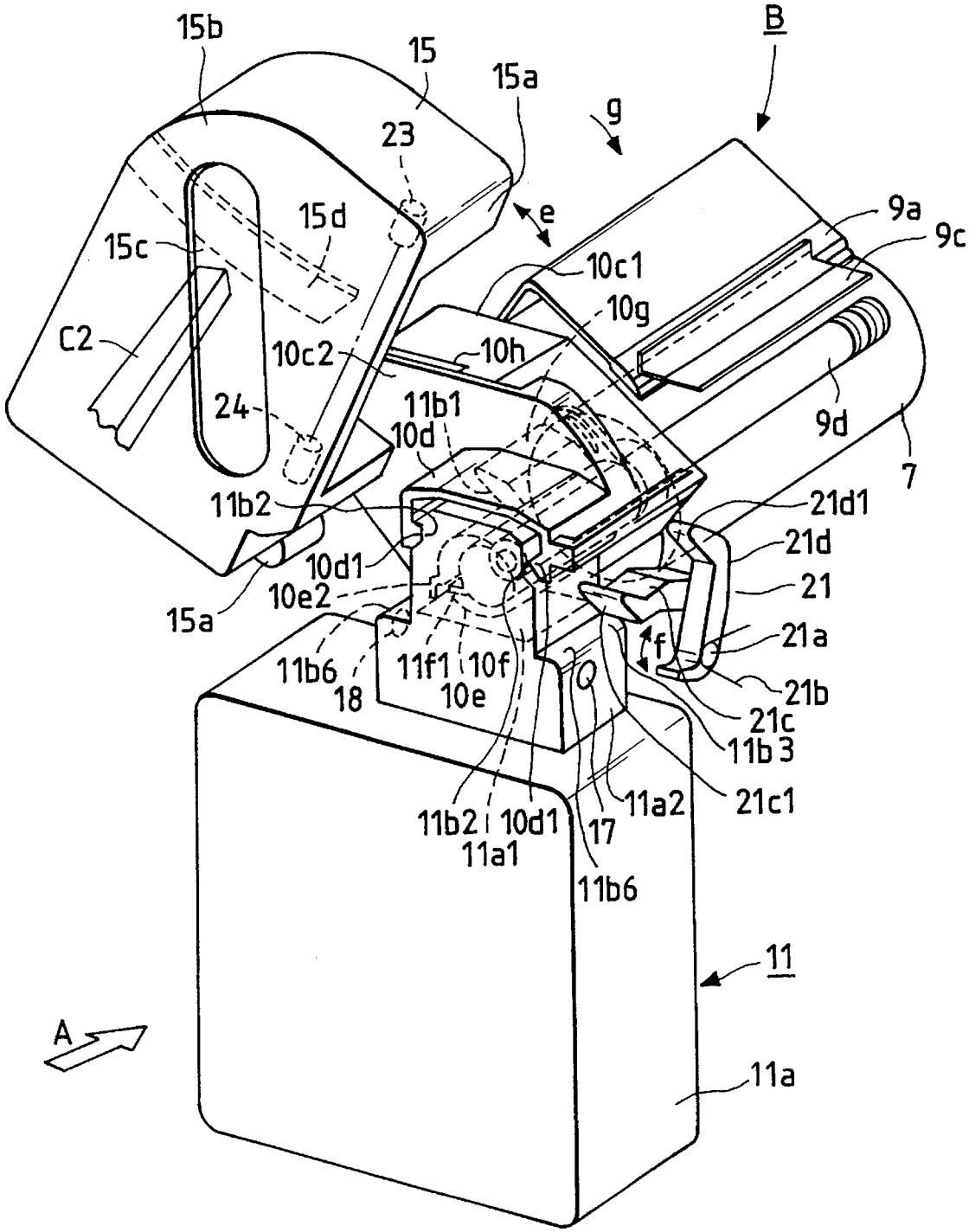
FIG. 3 is a perspective view showing a process for mounting a toner containing box to the image forming apparatus.
Figure 4:
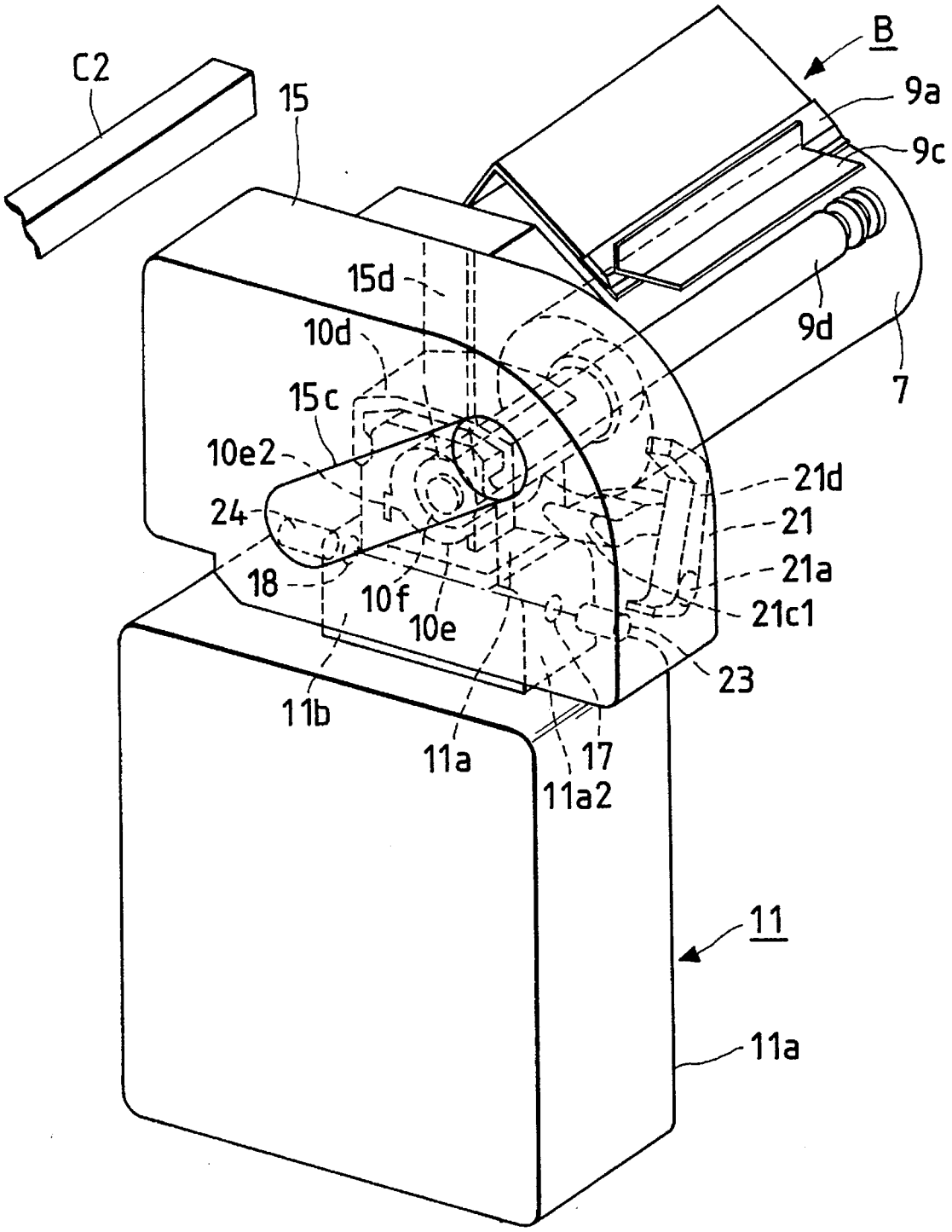
FIG. 4 is a perspective view showing a condition after the toner containing box is mounted to the image forming apparatus.
Figure 5B:
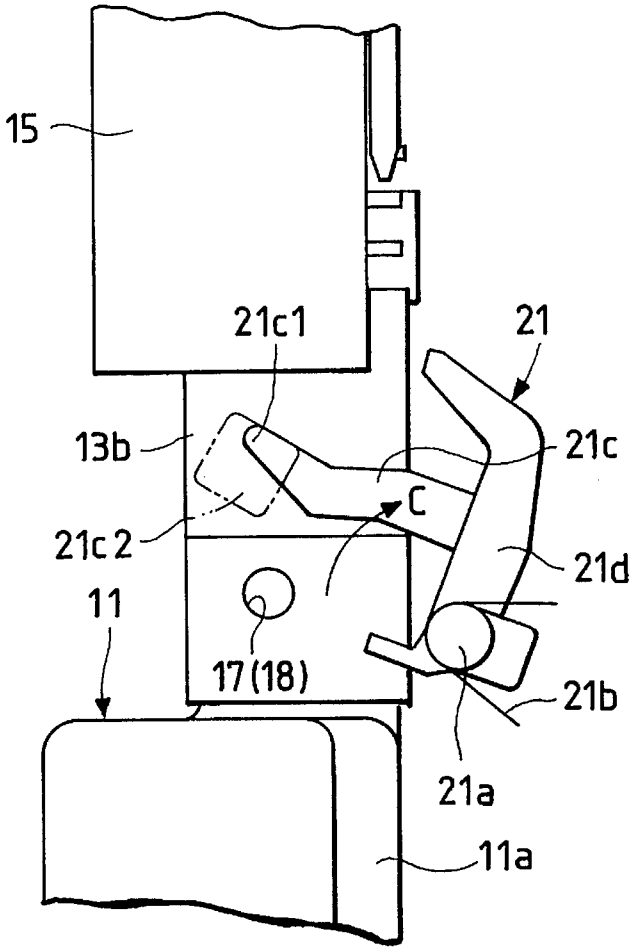
FIGS. 5A and 5B are views for explaining an operation of a preventing member.
Figure 5A:
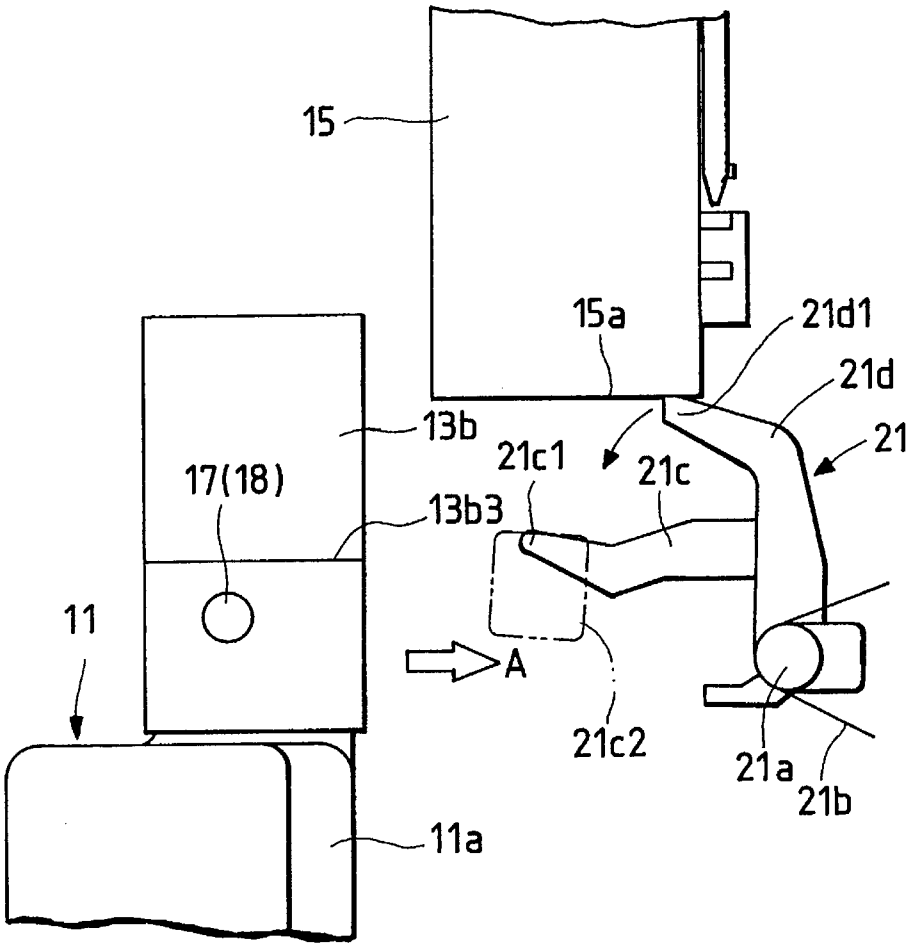
Figure 6A:
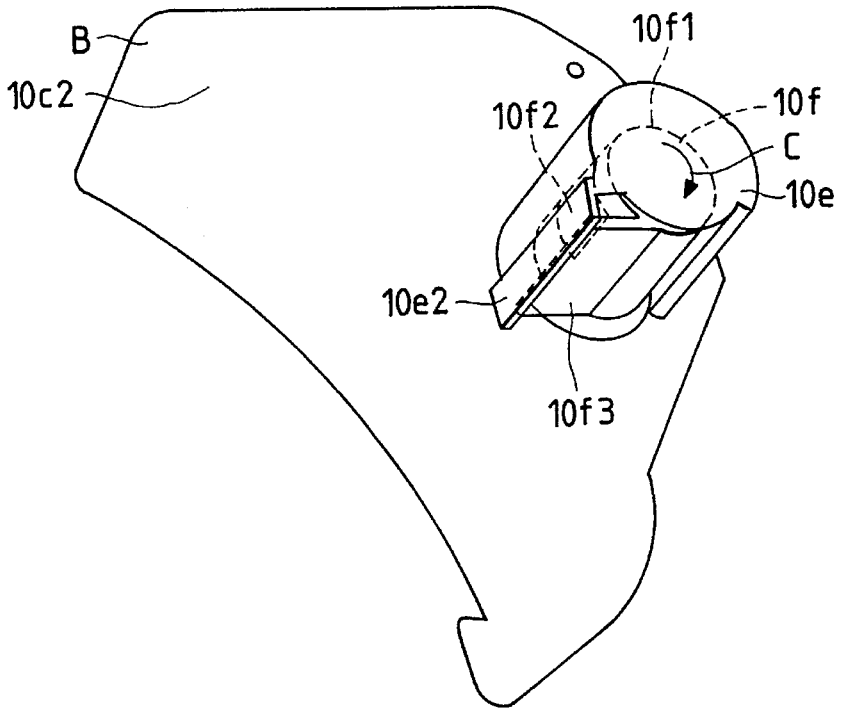
FIGS. 6A and 6B are views for explaining opening/closing of a discharge opening.
Figure 6B:
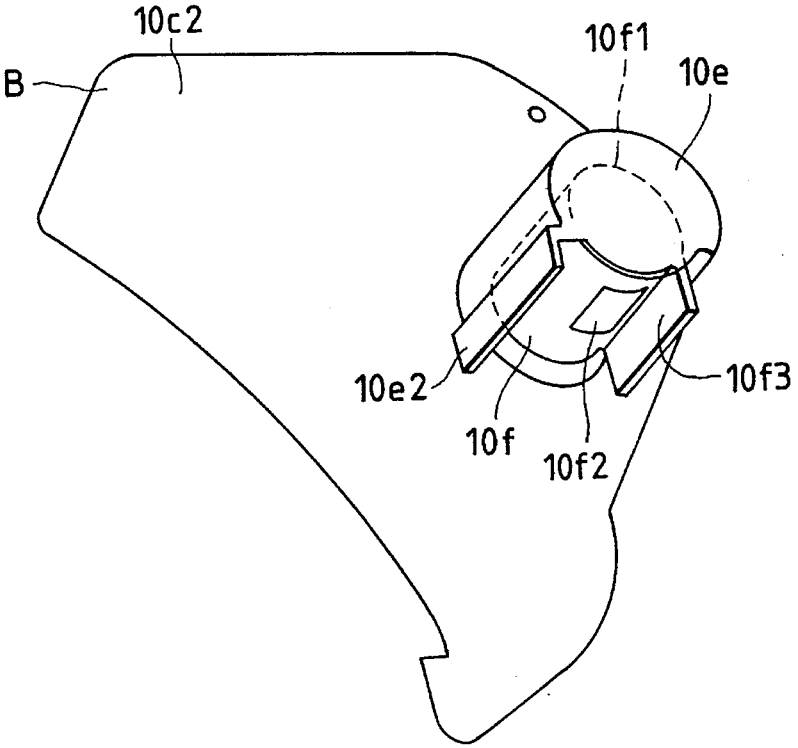
Figure 7:
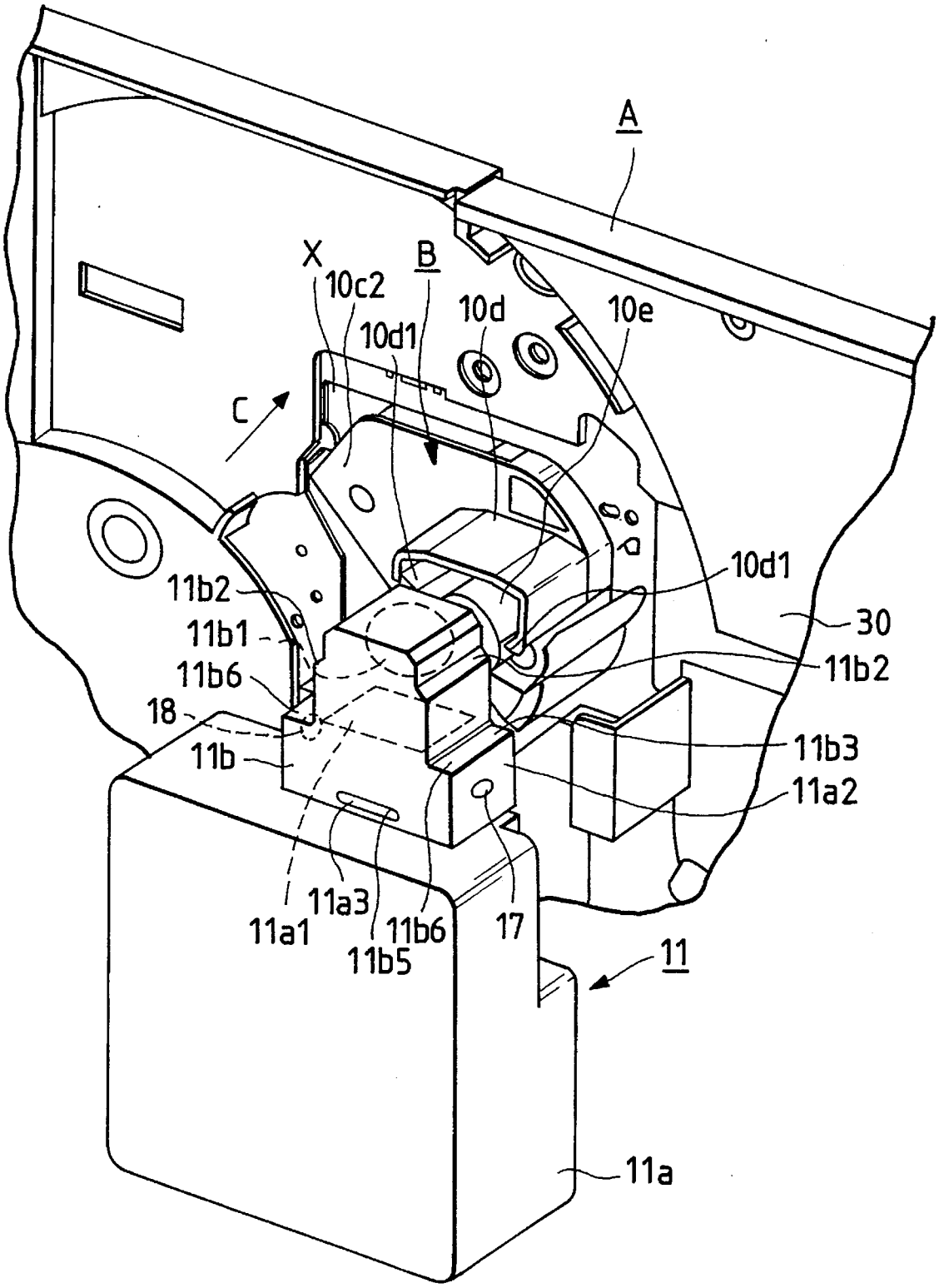
FIG. 7 is a perspective view for schematically showing a process for mounting a toner container to the image forming apparatus.
Figure 8:
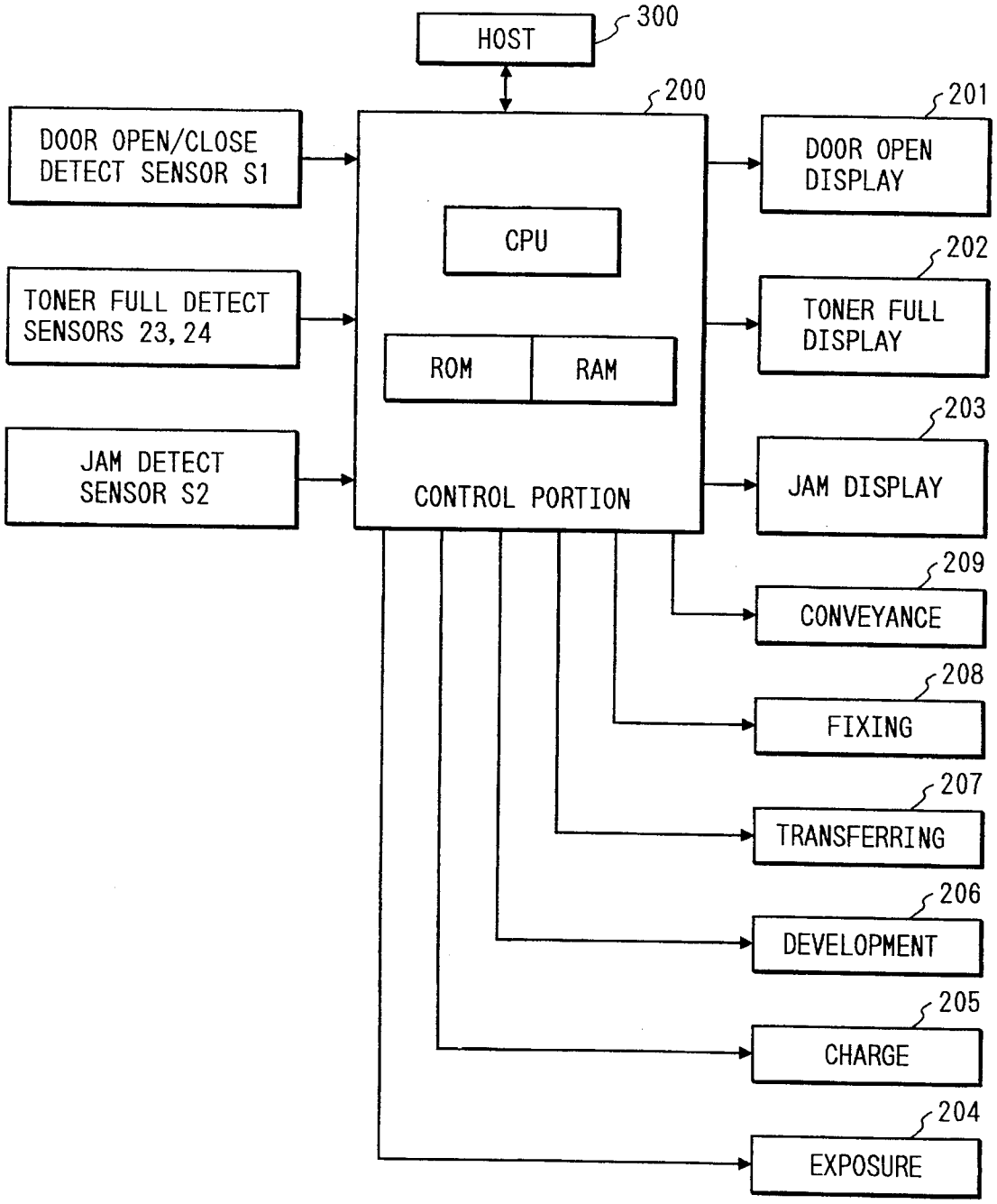
FIG. 8 is a schematic block diagram of a full-color laser beam printer to which an embodiment of the present invention is applied.

FIG. 3 is a perspective view showing a condition that the toner containing box 11 is being mounted to the printer (process cartridge B), FIG. 4 is a perspective view showing a condition after the toner containing box 11 has been mounted to the printer (process cartridge B), FIGS. 5A and 5B are views for explaining an operation of a preventing member, FIGS. 6A and 6B are views for explaining opening/closing of a discharge opening, and FIG. 7 is a perspective view for schematically showing a condition that the toner containing box is being mounted to the printer (process cartridge B), but a holding member 15 and the preventing member 21 are omitted from illustration. FIG. 8 is a schematic block diagram of a full-color laser beam printer to which the embodiment of the present invention is applied. Incidentally, in FIGS. 3 and 4, for clarify's sake, the frame of the process cartridge is omitted from illustration.

Referring now to FIG. 7, the opening/closing cover C is opened, the process cartridge B is inserted into a mounting portion X of the printer A along an axial direction of the photosensitive drum 7 (in a direction of now C). Then, the toner containing box 11 is mounted to the printer A. In this case, the toner containing box 11 is mounted to the printer A in a condition that it is supported by the process cartridge B.

More specifically, a grip portion 10*d* for mounting to and dismounting from the cartridge is formed on a front surface of a protruded wall 10*c*2 of the frame 10 of the process cartridge B in such a manner that a discharge cylinder 10*e* is enclosed by the grip portion 10*d* (see FIG. 3).

As shown in FIGS. 3, 4 and 7, two axial guide portions 10*d*1 for guiding and supporting the toner containing box 11 during the mounting and dismounting of the box are integrally formed on lower edges of the grip portion 10*d*. The toner containing box 11 is provided with a toner containing portion 11*a* having an upper stepped toner receiving portion 11*b* in which a toner dropping opening 11*b*1 is formed. The discharge cylinder 10*e* of the cartridge B can enter into the toner dropping opening 11*b*1. The toner containing box 11 is mounted to the cartridge while guiding an attachment surface 11*b*2 of the toner containing box 11 along a guide portion 10*d*1 formed on the grip portion 10*d*. Thus, the toner containing box 11 is mounted to the printer A in a condition that is supported by the discharge cylinder 10*e*. Since it is designed so that a difference between an outer diameter of the discharge cylinder 10*e* and an inner diameter of the toner dropping opening 11*b*1 is very small and since the connecting area between the discharge cylinder 10*e* and an inner diameter of the toner dropping opening 11*b*1 is substantially covered by the grip portion 10*d* having the guide portion 10*d*1, scattering of toner can be suppressed, thereby preventing contamination of the interior of the printer due to the toner leakage.

As shown in FIGS. 3, 4, 6A and 6B, within the grip portion 10*d* for dismounting the cartridge, the discharge cylinder 10*e* is protruded outwardly from the protruded wall 10*c*2. The discharge cylinder 10*e* is a notched cylinder having a lower opening 10*e*1 and a downwardly-protruded edge portion 10*e*2 disposed at one edge of the lower opening and extending in parallel with an axial direction of the toner convey screw 9*d*.

A cylindrical shutter 10*f* is rotatably mounted within the discharge cylinder 10*e* (FIGS. 6A and 6B). The shutter 10*f* is biased toward a direction C by a biasing means such as a spring (not shown) and has a waste toner drop preventing wall 10*f*1 extending in a tangential direction of the discharge cylinder 10*e* and a waste toner discharge opening 10*f*2 positioned at a downstream side of the wall 10*f*1 in the biasing direction. Normally, the shutter 10*f* is biased by the biasing means so that an upper surface 10*f*3 of the waste toner drop preventing wall 10*f*1 abuts against the downwardly-protruded edge portion 10*e*2 to close the waste toner discharge opening 10*f*2 by the wall of the discharge cylinder 10*e* (FIG. 6A).

The shutter 10*f* has a complete cylindrical hollow shape from the protruded wall 10*c*2 to an end wall 10*c*1 and is rotatably supported by a bearing (not shown) provided on the end wall 10*c*1. The toner convey screw 9*d* is penetrated into the shutter 10*f* (FIGS. 3 and 4). Between the end wall 10*c*1 and the protruded wall 10*c*2, a shutter release lever 10*g* is integrally formed on the outer wall of the shutter 10*f* so that the shutter release lever 10*g* is positioned below a clearance 10*h* as shown in FIG. 3. A lever 16 provided on a holding member 15 of the printer is penetrated into the clearance 10*h* to urge the shutter release lever 10*g* downwardly, so that the shutter 10*f* is rotated in opposition to the biasing force to open the waste toner discharge opening 10*f*2 (FIG. 6B). Incidentally, the holding member 15 serves to hold the toner containing box 11 at the discharge cylinder 10*e* which is a waste toner discharging portion for receiving the waste toner from the cleaning means, and the holding member 15 is rotatably supported by the printer frame via a support shaft 15*a*.

Accordingly, the toner containing box 11 is mounted to the process cartridge B by guiding the attachment surface 11*b*2 of the toner containing box 11 along the guide portion 10*d*1 of the grip portion 10*d*. Then, the holding member 15 is rotated to a holding position to rotate the shutter 10*f* within the discharge cylinder 10*e*, thereby opening the waste toner discharge opening 10*f*2 into the toner containing box 11. This position is maintained by the holding member 15. Thus, the toner containing box 11 is not advertently detached from the process cartridge B and scattering of toner is prevented.

Incidentally, the dismounting of the process cartridge B and the toner containing box 11 from the printer A is effected as follows. First of all, the holding member 15 is rotated in an anti-clockwise direction (from the condition shown in FIG. 4 to the condition shown in FIG. 3). Then, the toner containing box 11 is detached. Then, the operator dismounts the process cartridge B from the mounting portion X by gripping the grip portion 10*d*.

Next, an arrangement wherein the opening/closing cover C cannot be closed in a condition that the toner containing box 11 is not mounted to the printer A will be explained with reference to FIGS. 3 to 5B. Incidentally, the operator can know the fact that the toner containing box 11 is not mounted to the printer A by the fact that the opening/closing cover C cannot be closed. Further, since the opening/closing cover C is in an opened condition, the printer A is not driven.

Referring again to FIGS. 3 and 4, the holding member 15 is pivotally mounted on a side plate 30 (see FIG. 7) of the printer A for rocking movement around the shaft 15*a* in a direction of arrow e. Further, the preventing member 21 is supported for rocking movement in a direction of arrow f. The preventing member 21 is biased by a torsion spring 21*b* toward an anti-clockwise direction in FIG. 3. Arms 21*c*, 21*d* are integrally formed on the preventing member 21 substantially perpendicular to the latter (that is to say, the arm 21*c* is laid horizontally and the arm 21*d* stands substantially vertically). In the condition that the toner containing box 11 is not mounted to the printer A, a tip end 21*c*1 of the arm 21*c* is protruded into a mounting path of the toner containing box 11 by the biasing force of the spring 21*b* (FIGS. 3 and 5A). On the other hand, a tip end 21*d*1 of the arm 21*d* is protruded into a path for closing the holding member 15 (FIGS. 3 and 5A). Accordingly, when the operator tries to close the holding member 15 from the retard position (position shown in FIG. 3), the holding member 15 cannot be closed because the tip end 15*a* thereof abuts against the top end 21*d*1 of the arm 21*d*.

On the other hand, an elongated ridge 15*c* is formed on an outer surface 15*b* of the holding member 15. An abutment member C2 is formed in an inner surface of the opening/closing cover C is protruded toward the interior of the printer. When the holding member 15 is in the retract position, if the operator tries to close the cover C, the abutment portion C2 abuts against the ridge 15*c*, with the result that the cover C cannot be closed (FIG. 3). When the cover is not closed, a cover opening/closing detection sensor S1 is not actuated and does not send a cover close signal to a control portion 200. Thus, the printer A is not driven even if a print button (not shown) is turned ON. Further, a cover open display 201 is energized.

To the contrary, as shown in FIG. 4, when the toner containing box 11 is being mounted to the printer A as mentioned above, a shoulder portion 11*b*3 of the toner containing box 11 abuts against the tip end 21*c*1 of the arm 21*c*, thereby rotating the preventing member 21. As a result, the tip end 21*d*1 of the arm 21*d* is retarded (FIG. 5B) from the path through which the holding member 15 is closed. Accordingly, the holding member 15 is shifted from the retard position (FIG. 3) to the closed position (FIG. 4) to cover the grip portion 10*d* and the discharge cylinder 10*e*. In this condition, the mounting of the toner containing box 11 is completed.

Next, the function of the holding member 15 will be further explained.

The holding member 15 is provided with a lever 15*d* acting on the release lever 10*g*, and a stopper member (protruded portion) 15*c* which can abut against the abutment portion C2 of the cover C. Further, a pair of light emitting and light receiving elements 23, 24 are disposed in a confronting relation to constitute a detection mechanism for detecting whether the waste toner in the toner containing box 11 reaches a predetermined amount.

In the condition that the holding member 15 is opened as shown in FIG. 3, the toner containing box 11 is shifted in a direction of arrow AA to abut the toner receiving portion 11*b* against the fitting portions 10*d*1. When the toner containing box 11 is mounted at the predetermined position, the discharge cylinder 10*e* enters into the toner receiving portion 11*b* of the toner containing box 11. In this case, since the discharge cylinder 10*e* is biased as mentioned above, the waste toner discharge opening 10*f*2 is closed as shown in FIG. 6A. The toner is prevented from leaking through the waste toner discharge opening 10*f*2, thereby preventing the toner contamination of the interior of the printer.

When the toner containing box 11 is not mounted to the printer, as mentioned above, the arms 21*c*, 21*d* of the preventing member 21 are maintained in the condition shown in FIG. 3. In this condition, if the operator tries to close the holding member 15, when the latter is rotated around the support shaft 15*a* in a direction g in FIG. 3, as shown in FIG. 5A, the holding member 15 abuts against the tip end 21*d*1 of the upright arm 21*d* of the preventing member 21. Thus, the holding member 15 cannot be closed.

However, when the toner containing box 11 is shifted in the direction A in FIG. 3 to mount the box to the printer, as shown in FIG. 5B, the arm 21*c* of the preventing member 21 abuts against an end (shoulder) 11*b*3 of the toner receiving portion 11*b* of the toner containing box 11 to be rotated in the clockwise direction (shown by the arrow C) in FIG. 5B. As a result, the other arm 21*d* is also rotated in the same direction to be retarded. Consequently, in the condition that the toner containing box 11 is mounted, the interference between the holding member 15 and the arm 21*d* does not occur, and, thus, the holding member 15 can be completely closed as shown in FIG. 4.

When the holding member 15 is closed as mentioned above, the toner containing box 11 is kept in a condition that the dismounting of the box is prevented by the holding member 15 and the discharge cylinder 10*e* is penetrated into the toner receiving portion 11*b* of the toner containing box 11. Further, as shown in FIG. 4, the pair of light emitting and light receiving sensors 23, 24 provided on the holding member 15 are aligned with a pair of detection holes 17, 18 formed in the toner containing box 11 on both sides.

In the condition that the toner receiving portion 11*b* of the toner containing box 11 is covered by the holding member 15 as mentioned above (FIG. 4), as mentioned above, the discharge cylinder 10*e* is penetrated into the toner receiving portion 11*b* of the toner containing box 11 and the lever 15*d* of the holding member 15 is entered into the clearance 10*h* to urge the release lever 10*g*, thereby rotating the shutter 10*f*. As a result, the toner discharge opening 10*f*2 is opened as shown in FIGS. 6A and 6B to drop toner into the toner receiving portion 11*b*.

Accordingly, in the electrophotographic image formation process, after the transferring operation, residual toner remaining on the photosensitive drum 7 is scraped from the drum 7 by the cleaning blade 9*a*, and the removed toner is collected to the convey screw 9*d* by the agitating member 9*c*. The collected toner is conveyed to the toner containing box 11 by the rotating convey screw 9*d* along the axial direction of the screw and is discharged into the toner receiving portion 11*b* of the toner containing box 11 through the toner discharge opening 10*f*2. In this case, since the toner discharge opening 10*f*2 is deeply penetrated into the toner receiving portion 11*b*, the discharged toner is not overflown from the toner receiving portion 11*b*, thereby preventing toner contamination of the interior of the printer.

In a condition that the toner in the toner containing box 11 does not reach the predetermined amount, light emitted from the light emitting sensor 23 is not blocked by the toner and can reach the light receiving sensor 24 through the detection holes 17, 18. Thus, the light detection of the light receiving sensor 24 indicates the fact that the toner containing box 11 is not yet filled with toner. To the contrary, when the toner in the toner containing box 11 reaches the predetermined amount, the toner reaches the height of the detection holes 17, 18, and, thus, light emitted from the light emitting sensor 23 is blocked by the toner. As a result, the light does not reach the light receiving sensor 24, which indicates the fact that the toner containing box 11 is filled with toner. The "predetermined amount" means a limit amount wherein, if further toner is contained in the toner containing box, there is a danger of overflowing the toner from the box and is set to a slightly smaller value than the overflow amount. Further, when the fact the toner in the toner containing box 11 reaches the predetermined amount is detected by the sensors 23, 24, a signal is sent from the sensor 24 to the control portion 200, thereby activating a toner full display 202 and stopping the printer A.

Since the light emitting sensor 23 and the light receiving sensor 24 are held on the holding member 15, a separate member conventionally used for holding these sensors can be omitted, thereby making the printer cheaper.

According to the illustrated embodiment, in the condition that the toner containing box 11 is not mounted, since the holding member 15 abuts against the arm 21*d* of the preventing member 21 as mentioned above (FIG. 5A), the holding member 15 cannot be closed completely. In the condition that the holding member 15 is not closed completely, since the cover C of the printer cannot be closed by the interference between the cover and the holding member 15, the printer cannot be driven. Accordingly, in the condition that the toner containing box 11 is not mounted at the correct position in the printer, the printer is not driven. Thus, toner contamination of the printer can be avoided even if the operator forgets to mount the toner containing box to the printer, because the printer cannot be driven.

According to the illustrated embodiment, an electric sensor for detecting the presence/absence of the toner containing box 11 is not required, thereby making the printer cheaper.

Figure 9:
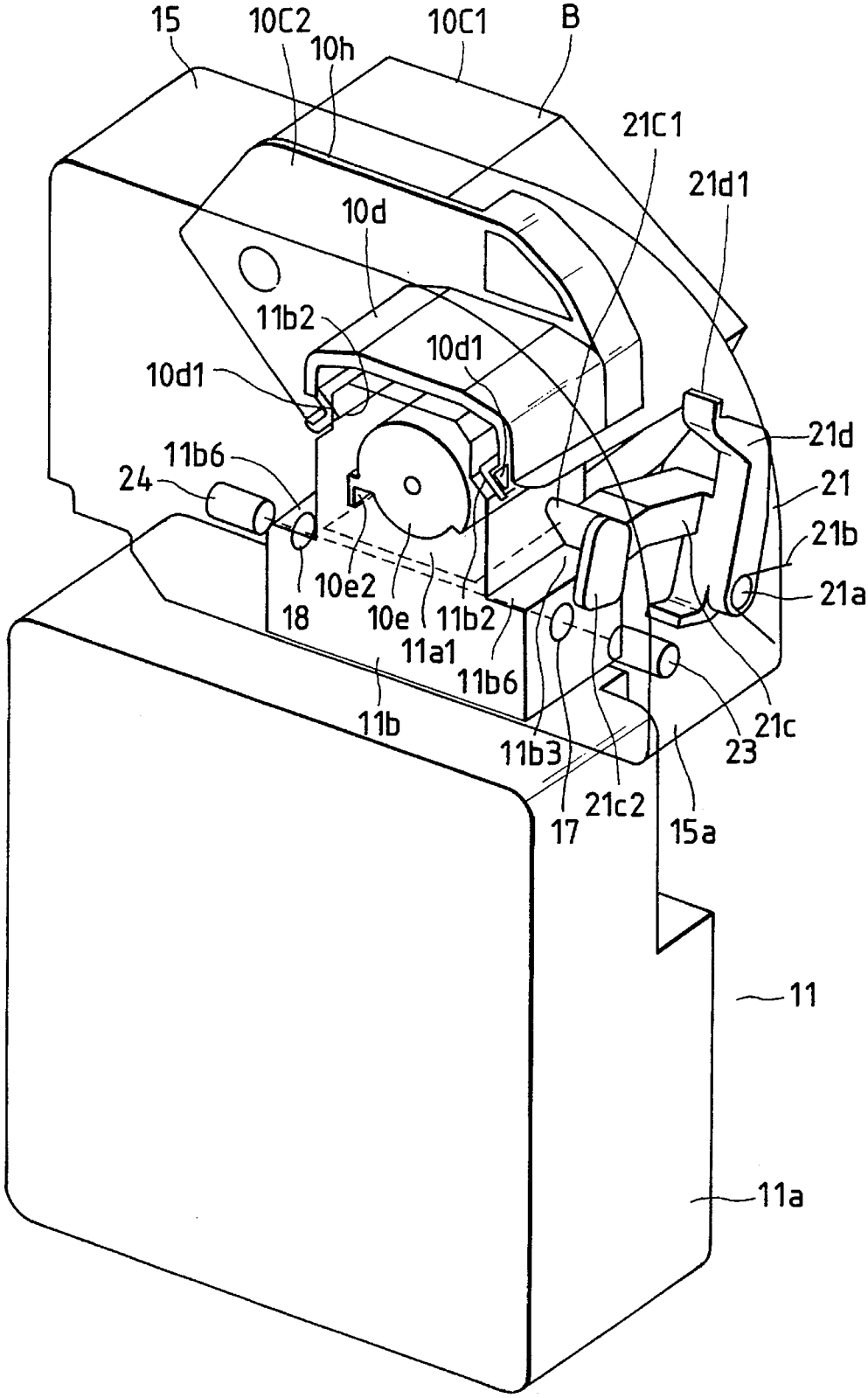
FIG. 9 is a perspective view of another embodiment of the present invention showing a condition that a toner container is mounted to a laser beam printer.
Figure 10:
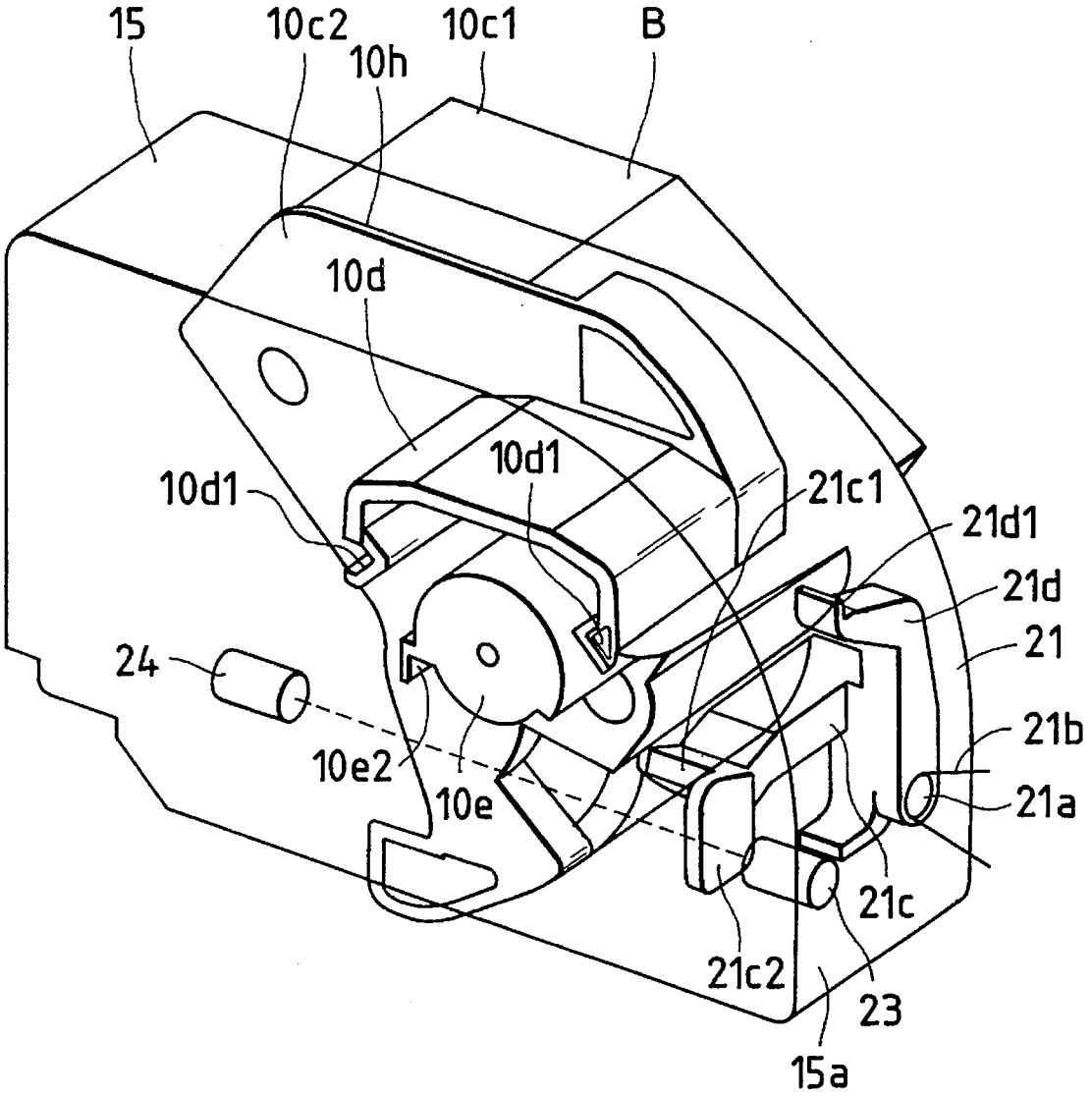
FIG. 10 is a perspective view of the printer showing a condition that the toner container is not mounted to the printer and a holding member is closed.

Next, a further embodiment of the present invention will be explained with reference to FIGS. 9 and 10.

In this embodiment, when the toner containing box 11 is not mounted to the printer A, the detection means (sensors 23, 24) detects a condition same as the condition that the toner containing box 11 reaches the predetermined amount. According to this embodiment, when the toner containing box 11 is not mounted to the printer A, even if the operator manually releases the preventing member 21 by his finger and closes the opening/closing cover C, the printer A can not be driven. To this end, in this embodiment, a side end piece 21*c*2 is formed on one side of the tip end 21*c*1 of the arm 21*c*. The side end piece 21*c*2 is protruded downwardly near the sensor 23. As shown in FIG. 9, in the condition that the toner containing box 11 is mounted to the printer and the arm 21*c* is rotated upwardly (FIG. 5B), the side end piece 21*c*2 does not block the light emitted from the sensor 23. However, as shown in FIG. 10, in the condition that the toner containing box 11 is not mounted, when the holding member 15 is closed (the opening/closing cover C is closed), the arm 21*c* is rotated downwardly (FIG. 5A), with the result that the light from the sensor 23 is blocked by the side end piece 21*c*2. Thus, light from the sensor 23 does not reach the sensor 24. Consequently, the sensor 24 judges that the light is blocked by the toner reaching the predetermined amount, and sends the toner full signal to the control portion 200, with the result that the toner full display 202 is energized and the printer A is stopped. Accordingly, the operator knows that the toner containing box 11 is not mounted to the printer.

Now, the toner containing box 11 will be explained. As shown in FIGS. 3, 4, 7 and 9, the toner containing box has a rectangular toner containing portion 11*a* provided at its upper part with an attachment portion 11*a*2 having an opening 11*a*1. The toner containing portion 11*a* and the attachment portion 11*a*2 are integrally formed from resin. Incidentally, the detection holes 17, 18 are formed in left and right side walls of the attachment portion 11*a*2. The toner receiving portion 11*b* is secured on the attachment portion 11*a*2 by fitting openings 11*b*5 (only one of which is shown in FIG. 7) of the toner receiving portion 11*b* onto pegs 11*a*3 of the attachment portion 11*a*2. The toner receiving portion 11*b* is made of transparent resin. The toner receiving portion 11*b* has a front toner dropping opening 11*b*1 into which the discharge cylinder 10*e* is penetrated. The toner dropped from the discharge cylinder 10*e* is collected into the toner containing portion 11*a* through the opening 11*a*1. Attachment surfaces 11*b*2 inclined along the mounting direction are formed on left and right sides of the toner dropping opening 11*b*1. Further, flat portions 11*b*6 are formed on the toner receiving portion 11*b* at a height substantially the same as that of the opening 11*a*1 on both sides thereof. When the toner containing box is mounted to the printer, the arm 21*c* is pushed upwardly by a shoulder portion 11*b*3 on one of the flat portions 11*b*6.

Incidentally, the toner containing portion 11*a* and the toner receiving portion 11*b* may be integrally formed. Further, in place of the detection holes 17, 18, light permeable windows may be provided in the light path from the sensor 23 to the sensor 24. The toner receiving portion 11*b* may be opaque. However, in this case, light permeable windows are provided in the toner receiving portion along the light path from the sensor 23 to the sensor 24. When the toner containing portion 11*a* and the toner receiving portion 11*b* are integrally formed, light permeable windows or holes may be formed in the light path from the sensor 23 to the sensor 24.

Next, the function block diagram of the full-color laser beam printer according to the above-mentioned embodiment will be explained with reference to FIG. 8.

In FIG. 8, the control portion 200 controls the entire operation of the printer and includes a CPU such as a microprocessor, a ROM for storing a control program for the CPU and other various data, and a RAM used as a work area of the CPU and adapted to temporarily store various data.

The control portion 200 receives signals from the cover opening/closing detection sensor S1, toner full detection sensor 23, 24 and the jam detection sensor S2. On the basis of such signals, the control portion 200 controls various processes such as exposure 204 (scanner portion 3), charge 205 (charge means 8), development 206 (developing unit 4), transferring 207 (transfer means 2), fixing 208 (fixing means 5) and conveyance 209 (rollers 1*b*, 1*c*, 1*e* and 1*f*) of the recording sheet.

When the control portion 200 receives the door open/close signal from the door open/close direction sensor S1, the door open display 201 is energized and the printer A is stopped. When the control portion 200 receives the toner full detection sensor 23, 24, the toner full detection display 202 is energized and the printer A is stopped. Similarly, when the control portion 200 receives the jam signal from the jam detection sensor S2, the jam display 203 is energized and the printer A is stopped. Incidentally, the above displays may be provided on the printer or provided on a host computer 300.

According to the aforementioned embodiments, the toner containing box reliably can be held by the holding member with relatively cheap cost and without using an additional lock mechanism, and toner leakage reliably can be prevented. Further, when the toner containing box is not held by the holding member, the discharge opening of the discharge cylinder is closed. The discharge opening of the discharge cylinder is opened in synchronous with the holding operation of the holding member. Thus, toner leakage can be prevented more actively. Further, since an additional holding member for providing a detection mechanism for detecting the fact that the toner in the toner containing box reaches the predetermined amount can be omitted, the printer can be made cheaper.

In addition, since the printer can be stopped when the toner containing box is not mounted to the printer without providing any electric sensor for detecting the presence/absence of the toner containing box, toner contamination of the interior of the printer can be avoided. Thus, an image forming apparatus wherein the toner containing box reliably can be held by the holding member with relatively cheap cost and without using an additional lock mechanism and toner leakage reliably can be prevented can be provided.

As mentioned above, according to the present invention, there is provided an image forming apparatus which can prevent the scattering of the toner.

What is claimed is:

1. An image forming apparatus for forming an image on a recording medium, comprising:

a main body of the image forming apparatus;

a toner container mounting means for removably mounting a toner container containing toner removed from an image bearing member provided in said main body, said toner container being removably mounted to said main body;

an opening/closing member openable with respect to said main body to be opened and closed to dismount and mount said toner container with respect to said main body; and a regulating means for regulating the closing of said opening/closing member when said toner container is not mounted to said main body.

2. An image forming apparatus according to claim 1, wherein said toner container mounting means has a cylindrical member for directing the toner removed from said image bearing member to said toner container, and supporting said toner container.

3. An image forming apparatus according to claim 2, wherein said cylindrical member is provided on a process cartridge incorporating therein an electrophotographic photosensitive member as said image bearing member, a charge means for charging said electrophotographic photosensitive member, and a cleaning means for removing the residual toner remaining on said electrophotographic photosensitive member as an unit, and can removably be mounted to said main body of the image forming apparatus.

4. An image forming apparatus according to claim 3, wherein said process cartridge can removably be mounted to said main body of the image forming apparatus by opening said opening/closing member with respect to said main body.

5. An image forming apparatus according to claim 3, wherein said electrophotographic photosensitive member has a drum shape, said charge means is a charge roller followingly rotated to said electrophotographic photosensitive member, and said cleaning means is an elastic cleaning blade contacted with said electrophotographic photosensitive member.

6. An image forming apparatus according to claim 1 or 2, wherein said regulating means includes a cover pivotally mounted on said main body and shiftable between a permitting position where the closing of said opening/closing member is permitted and a regulating position where the closing of said opening/closing member is inhibited, and a regulating member pivotally mounted on said frame and shiftable between a permit position where the shifting of said cover to said permitting position is permitted and a regulate position where the shifting of said cover to said permitting position is inhibited; and said regulating member is shifted to said permit position by contacting with said toner container being mounted to said main body, and then, said opening/closing member can be closed with respect to said main body by shifting said cover to said permitting position.

7. An image forming apparatus according to claim 6, wherein said cover is provided with a detection means for detecting the fact that the toner in said toner container reaches a predetermined amount, and when said detection means detects the fact that the toner in said toner container reaches the predetermined amount, said detection means emits an alarm indicating a need for an exchange of the toner container.

8. An image forming apparatus according to claim 7, wherein said detection means includes a light emitting element and a light receiving element disposed with the interposition of said toner container.

9. An image forming apparatus according to claim 7, wherein, when said detection means detects the fact that the toner in said toner container reaches the predetermined amount, the image forming apparatus is stopped.

10. An image forming apparatus according to claim 1, 2 or 3, wherein the main body contains a plurality of different color toners for developing a latent image formed on an electrophotographic photosensitive member as said image bearing member, and different color toner images formed on said electrophotographic photosensitive member as said image bearing member by the different color toners are successively transferred onto the recording medium in a superimposed fashion.

11. An image forming apparatus according to claim 10, wherein said plurality of different color toners include yellow color toner, magenta color toner, cyan color toner and black color toner.

12. An image forming apparatus according to claim 1, wherein the electrophotographic image forming apparatus is a full-color laser beam printer.

13. An image forming apparatus according to claim 1, wherein the electrophotographic image forming apparatus is a full-color facsimile machine.

14. An image forming apparatus according to claim 1, wherein the electrophotographic image forming apparatus is a full-color copying machine.

15. An image forming apparatus according to claim 6, wherein the main body contains a plurality of different color toners for developing a latent image formed on an electrophotographic photosensitive member as said image bearing member, and different color toner images formed on said electrophotographic photosensitive member as said image bearing member by the different color toners are successively transferred onto the recording medium in a superimposed fashion.

16. An image forming apparatus for forming an image on a recording medium, comprising:

a main body of the image forming apparatus;

a toner container mounting means for removably mounting a toner container for containing toner removed from an image bearing member provided in said main body, said toner container being removably mounted to said main body; and a detection means for detecting a condition that the toner in said toner container has not risen to a predetermined amount when said toner container is mounted onto said main body and a condition that said toner container is not mounted onto said main body.

17. An image forming apparatus according to claim 16, wherein said toner container mounting means has a cylindrical member for directing the toner removed from said image bearing member to said toner container supporting said toner container.

18. An image forming apparatus according to claim 17, wherein said cylindrical member is provided on a process cartridge incorporating therein an electrophotographic photosensitive member as said image bearing member, a charge means for charging said electrophotographic photosensitive member, and a cleaning means for removing the residual toner remaining on said electrophotographic photosensitive member as an unit which can removably be mounted to said main body of the image forming apparatus.

19. An image forming apparatus according to claim 18, wherein said process cartridge can removably be mounted to said main body of the image forming apparatus by opening an opening/closing member with respect to said main body.

20. An image forming apparatus according to claim 18, wherein said electrophotographic photosensitive member has a drum shape, said charge means is a charge roller rotated following to said electrophotographic photosensitive member, and said cleaning means comprises an elastic cleaning blade contacted with said electrophotographic photosensitive member.

21. An image forming apparatus according to claim 16 or 17, further comprising a cover pivotally mounted on said main body and shiftable between a permitting position where the closing of said opening/closing member is permitted and a regulating position where the closing of said opening/closing member is inhibited, and a regulating member pivotally mounted on said main body and shiftable between a permit position where the shifting of said cover to said permitting position is permitted and a regulate position where the shifting of said cover to said permitting position is inhibited, and said detection means is provided on said cover while and said detected means is provided on said regulating member.

22. An image forming apparatus according to claim 16, wherein, when said detection means detects the fact that the toner mounted in said toner container reaches the predetermined amount, said detection means emits a signal for displaying an alarm indicating a need for an exchange of said toner container.

23. An image forming apparatus according to claim 22, wherein said detection means comprises a light emitting element and a light receiving element disposed with the interposition of said toner container.

24. An image forming apparatus according to claim 22, wherein, when said detection means detects the fact that the toner in said toner container reaches the predetermined amount, the image forming apparatus stops operation thereof.

25. An image forming apparatus according to claim 22, wherein, when said toner container is not mounted on said toner container mounting means, said detected means is positioned between said light emitting element and said light receiving element for receiving light from said light emitting element for preventing the light from said light emitting element from reaching said light receiving element.

26. An image forming apparatus according to claim 16, 17 or 18, wherein the image forming apparatus contains a plurality of different color toners for developing a latent image formed on an electrophotographic photosensitive member as said image bearing member, and different color toner images formed on said electrophotographic photosensitive member as said image bearing member by the different color toners are successively transferred onto the recording medium in a superimposed fashion.

27. An image forming apparatus according to claim 26, wherein said plurality of different color toners include yellow color toner, magenta color toner, cyan color toner and black color toner.

28. An image forming apparatus according to claim 16, wherein the electrophotographic image forming apparatus is a full-color laser beam printer.

29. An image forming apparatus according to claim 16, wherein the electrophotographic image forming apparatus is a full-color facsimile machine.

30. An image forming apparatus according to claim 16, wherein the electrophotographic image forming apparatus is a full-color copying machine.

31. An image forming apparatus according to claim 15, wherein said plurality of different color toners include yellow color toner, magenta color toner, cyan color toner and black color toner.

32. An image forming apparatus according to claim 21, wherein, when said detection means detects the fact that the toner in said toner container reaches the predetermined amount, said detection means emits a signal for displaying an alarm indicating a need for an exchange of the toner container.

33. An image forming apparatus according to claim 32, wherein said detection means comprises a light emitting element and a light receiving element disposed with the interposition of said toner container.

34. An image forming apparatus according to claim 32, wherein, when said detection means detects the fact that the toner in said toner container reaches the predetermined amount, the image forming apparatus stops operation thereof.

35. An image forming apparatus according to claim 32, wherein, when said toner container is not mounted on said toner container mounting means, said detected means is positioned between said light emitting element and said light receiving element for receiving light from said light emitting element for preventing the light from said light emitting element from reaching said light receiving element.

36. An image forming apparatus according to claim 21, wherein the image forming apparatus contains a plurality of different color toners for developing a latent image formed on an electrophotographic photosensitive member as said image bearing member, and different color toner images formed on said electrophotographic photosensitive member as said image bearing member by the different color toners are successively transferred onto the recording medium in a superimposed fashion.

37. An image forming apparatus according to claim 36, wherein said plurality of different color toners include yellow color toner, magenta color toner, cyan color toner and black color toner.

38. An image forming apparatus:

a main body of the image forming apparatus including a process cartridge removably mountable thereon;

a toner container mounting means for removably mounting a toner container containing toner removed from an image bearing member provided in said main body, said toner container mounting means being removably mountable to said main body; and an opening/closing member operable with respect to said main body to be opened and closed to dismount and mount said toner container with respect to said main body;

wherein said toner container is mounted onto the main body by engaging a part thereof with a mounting grip of a process cartridge removably mountable on the main body.

* * * * *

UNITED STATES PATENT AND TRADEMARK OFFICE

CERTIFICATE OF CORRECTION

PATENT NO. : 5,589,915 Page 1 of 3

DATED : December 31, 1996

INVENTOR(S) : KOUJI HASHIMOTO

It is certified that error appears in the above-indentified patent and that said Letters Patent is hereby corrected as shown below:

Title page

[57] ABSTRACT

Line 10, "devise" should read --device is provided--.

COLUMN 2

Line 43, "In synchronous" should read --Synchronously--.
Line 66, "a" should read --an--.

COLUMN 3

Line 8, "means 1" should read --means 1 conveys--.
Line 21, "discharged" should read --discharge--.
Line 22, "roller" should read --rollers-.

COLUMN 4

Line 31, "in" should be deleted.
Line 32, "synchronous" should read --synchronously--.

UNITED STATES PATENT AND TRADEMARK OFFICE

CERTIFICATE OF CORRECTION

PATENT NO. : 5,589,915

DATED : December 31, 1996

INVENTOR(S) : KOUJI HASHIMOTO

It is certified that error appears in the above-indentified patent and that said Letters Patent is hereby corrected as shown below:

COLUMN 5

Line 51, "celenium," should read --selenium,--.

COLUMN 6

Line 35, "clarify's" should read --clarity's--.
Line 38, "the" should read --and the--.
Line 40, "now" should read --arrow--.

COLUMN 8

Line 31, "is" should read --and is--.

COLUMN 10

Line 12, "box and" should read --box, and which--.
Line 51, "can not" should read --cannot--.

COLUMN 12

Line 7, "in synchronous" should read --synchronously--.

UNITED STATES PATENT AND TRADEMARK OFFICE

CERTIFICATE OF CORRECTION

PATENT NO. : 5,589,915 Page 3 of 3

DATED : December 31, 1996

INVENTOR(S) : KOUJI HASHIMOTO

It is certified that error appears in the above-indentified patent and that said Letters Patent is hereby corrected as shown below:

COLUMN 14

Line 33, "following" should read --followingly--.
Line 48, "and" should be deleted.

Signed and Sealed this

First Day of July, 1997

Bruce Lehman

*Attest:*

BRUCE LEHMAN

*Attesting Officer*

*Commissioner of Patents and Trademarks*